US010718505B2

(12) United States Patent
Di Giovine

(10) Patent No.: US 10,718,505 B2
(45) Date of Patent: Jul. 21, 2020

(54) ILLUMINATION DEVICE

(71) Applicant: C&E GROUP S.R.L., Oggiono (IT)

(72) Inventor: Alfonso Di Giovine, Oggiono (IT)

(73) Assignee: C&E GROUP S.R.L., Oggiono (IT)

( * ) Notice: Subject to any disclaimer, the term of this patent is extended or adjusted under 35 U.S.C. 154(b) by 0 days.

(21) Appl. No.: 16/600,511

(22) Filed: Oct. 13, 2019

(65) Prior Publication Data

US 2020/0124266 A1 Apr. 23, 2020

(30) Foreign Application Priority Data

Oct. 19, 2018 (IT) ..... 102018000009625

(51) Int. Cl.

| | |
|---|---|
| ***F21V 29/58*** | (2015.01) |
| ***F21V 7/00*** | (2006.01) |
| ***F21V 15/01*** | (2006.01) |
| ***F21V 29/503*** | (2015.01) |
| ***F21V 29/67*** | (2015.01) |
| ***F21Y 115/10*** | (2016.01) |
| ***F21S 8/00*** | (2006.01) |
| ***F21S 8/08*** | (2006.01) |

(52) U.S. Cl.

CPC ..... *F21V 29/59* (2015.01); *F21V 7/0008* (2013.01); *F21V 15/01* (2013.01); *F21V 29/503* (2015.01); *F21S 8/036* (2013.01); *F21S 8/085* (2013.01); *F21V 29/67* (2015.01); *F21Y 2115/10* (2016.08)

(58) Field of Classification Search

CPC ..... F21V 29/59; F21V 29/503; F21V 7/0008; F21V 15/01

See application file for complete search history.

(56) References Cited

U.S. PATENT DOCUMENTS

| | | | | |
|---|---|---|---|---|
| 2016/0348885 | A1 | 12/2016 | Yang et al. | |
| 2017/0030567 | A1* | 2/2017 | Sun | F21V 29/56 |
| 2018/0295785 | A1* | 10/2018 | Ross | A01G 9/26 |

FOREIGN PATENT DOCUMENTS

| | | | |
|---|---|---|---|
| EP | 3276258 | A1 | 1/2018 |
| GB | 2465493 | A | 5/2010 |
| WO | 2015060475 | A1 | 4/2015 |
| WO | 2017060364 | A1 | 4/2017 |

* cited by examiner

*Primary Examiner* — Thomas M Sember

(74) *Attorney, Agent, or Firm* — Mark M. Friedman

(57) ABSTRACT

Illumination device which comprises multiple illumination modules, each provided with a corresponding group of light sources. A liquid cooling plant is connected to the light sources in order to dissipate heat generated by the latter. The cooling plant is provided with a heat exchanger comprising a manifold provided with a passage channel having an inlet branch and an outlet branch. The heat exchanger further comprises a transmission block, which carries the illumination modules mounted thereon and is provided with multiple cooling tracks, which are hydraulically connected, parallel to each other, to the inlet branch and to the outlet branch of the passage channel of the manifold. Each cooling track is arranged at a respective illumination module in order to transfer the heat generated by the light sources of such illumination module to a coolant fluid which traverses the cooling track.

10 Claims, 10 Drawing Sheets

ILLUMINATION DEVICE

FIELD OF APPLICATION

The present invention refers to an illumination device.

The present illumination device is inserted in the industrial field of production of illumination plants and devices, in particular provided with light sources of LED type, and is advantageously employable for design in the illuminating engineering field, in particular in systems with high light intensity.

Advantageously, the present illumination device is intended to be employed for illuminating outside environments, such as in particular for illuminating airport areas (e.g. airplane waiting/parking areas, parking zones, de-icing stations, service tracks), or even squares, parking lots, parks, industrial areas, streets, etcetera. The present device is advantageously also employable for illuminating interior environments such as cinemas, industrial sheds, warehouses, rooms, offices.

STATE OF THE ART

Illumination devices provided with light sources of LED type are increasingly diffused on the market, since the latter demonstrate increased light efficiency with respect to most of the light sources of conventional type (such as incandescent lamps, fluorescent lamps, discharge lamps).

In particular, LED illumination devices are known, employed for illuminating large outside areas, such airport waiting/parking areas. Such illumination devices are normally mounted on pylons of high height (e.g. 40-50 meters) and they must be able to ensure the generation of an intense luminous flux, e.g. 140000 lumen.

Generally, such illumination devices of known type comprise a box-like containment body, within which multiple LEDs are arranged which are mounted on printed circuits fixed to the walls of the same box-like body. The latter is frontally provided with a transparent side through which the light beams emitted by the LEDs are projected towards the area to be illuminated. In order to ensure the generation of a high light intensity, the aforesaid illumination devices of known type comprise a high number of LEDs, with consequent production of a high quantity of heat during the operation thereof.

On such matter, the illumination device is provided with a plurality of plate-like dissipators fixed on the external surface of the containment body and thermally connected to the printed circuits of the LEDs in order to dissipate the heat emitted by the latter into the air around the device.

Such plate-like dissipators, nevertheless, allow dissipating a limited quantity of heat and, consequently, require distributing the LEDs of the device over a relatively large area (e.g. more than a square meter) so as to associate each LED with a sufficiently large portion of the plate-like dissipators in order to prevent an overheating of the LEDs, which causes a considerable drop of their efficiency and a significant reduction of their operating lifetime. This involves a large extension of the illumination device, which consequently is subjected to stresses caused for example by the action of the wind, and it has a considerable weight, complicating the operations of installation at high height.

In addition, in order to concentrate the light intensity of each LED, the device comprises multiple collimation lenses arranged in front of the LEDs, which have relatively large dimensions hence they occupy a considerable space within the containment body, further involving large dimensions of the latter.

In order to ensure an improved thermal dissipation of the heat produced by the LEDs, illumination devices were introduced on the market that were provided with liquid cooling systems.

For example, the Chinese patent application No. CN 106958802 describes an LED projector for a street lamp, which comprises a cooling circuit provided with a first heat exchanger arranged in the containment body of the projector at the LEDs and adapted to transfer the heat generated by the latter to the cooling liquid that traverses it. In addition, the cooling circuit comprises a second heat exchanger intended to receive the cooling liquid coming from the aforesaid first heat exchanger in order to transmit the heat absorbed by such liquid to outside the projector. In addition, a pump is provided that is adapted to circulate the cooling liquid between the first heat exchanger and the second heat exchanger. In particular, the first heat exchanger associated with the LEDs comprises a box-like body made of aluminum, internally provided with a coil-like channel traversed by the cooling liquid.

Also the latter solution of known type, however, has in practice shown that it does not lack drawbacks. In particular, the shaping of the channel of the box-like body results in the cooling liquid, advancing along the channel, increasingly absorbing heat from the LEDs arranged at each section of the channel itself. Consequently, the cooling liquid, when it reaches the final section of the channel, has a temperature significantly higher than that which it has at the inlet of the channel, determining a smaller absorption of the heat of the LEDs arranged in the final section of the channel, and thus involving a higher operating temperature of such LEDs with a consequent loss of efficiency of the latter.

PRESENTATION OF THE INVENTION

In this situation, the object of the present invention is therefore that of overcoming the drawbacks manifested by the solutions of known type, by providing an illumination device capable of generating an intense luminous flux and simultaneously having relative compact dimensions.

Further object of the present invention is to provide an illumination device capable of ensuring a high light efficiency and a long lifetime duration of the light sources. Further object of the present invention is to provide an illumination device which is structurally simple and inexpensive to produce.

BRIEF DESCRIPTION OF THE DRAWINGS

The technical characteristics of the invention, according to the aforesaid objects, can be clearly found in the contents of the below-reported claims and the advantages thereof will be more evident from the following detailed description, made with reference to the enclosed drawings, which represent a merely exemplifying and non-limiting embodiment, in which:

DETAILED DESCRIPTION OF A PREFERRED EMBODIMENT

Figure 1:
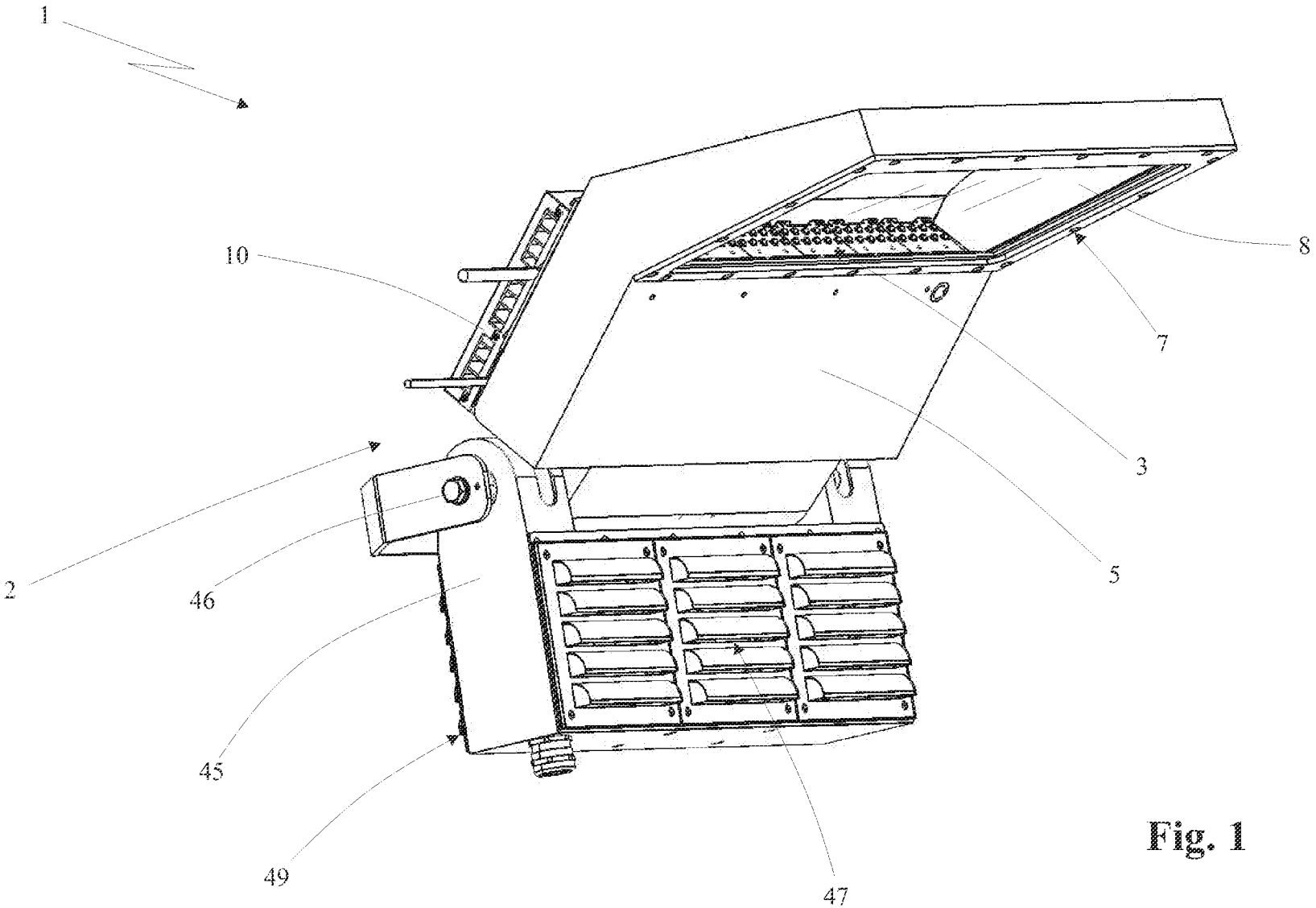
FIG. 1 shows a front perspective view of the illumination device, object of the present invention.

With reference to the enclosed drawings, reference number 1 overall indicates the illumination device, object of the present invention, which is intended to be mounted on a support (not illustrated), for example a support pole (also of considerable height, such as 40-45 meters) arranged on the area to be illuminated, such as airport areas, squares, parking lots, parks, industrial areas, streets etcetera. Of course, the present illumination device 1 can be mounted on supports of different type (such as a frame mounted on a wall of a building) and can be employed for illuminating interior environments as well. In accordance with the enclosed figures, the illumination device 1 comprises a support structure 2 intended to be fixed to the aforesaid support.

In addition, the illumination device 1 comprises multiple illumination modules 3 mounted on the support structure 2 and each comprising a corresponding group of light sources 4, preferably of LED type, adapted to emit light beams for illuminating the environment.

Figure 2:
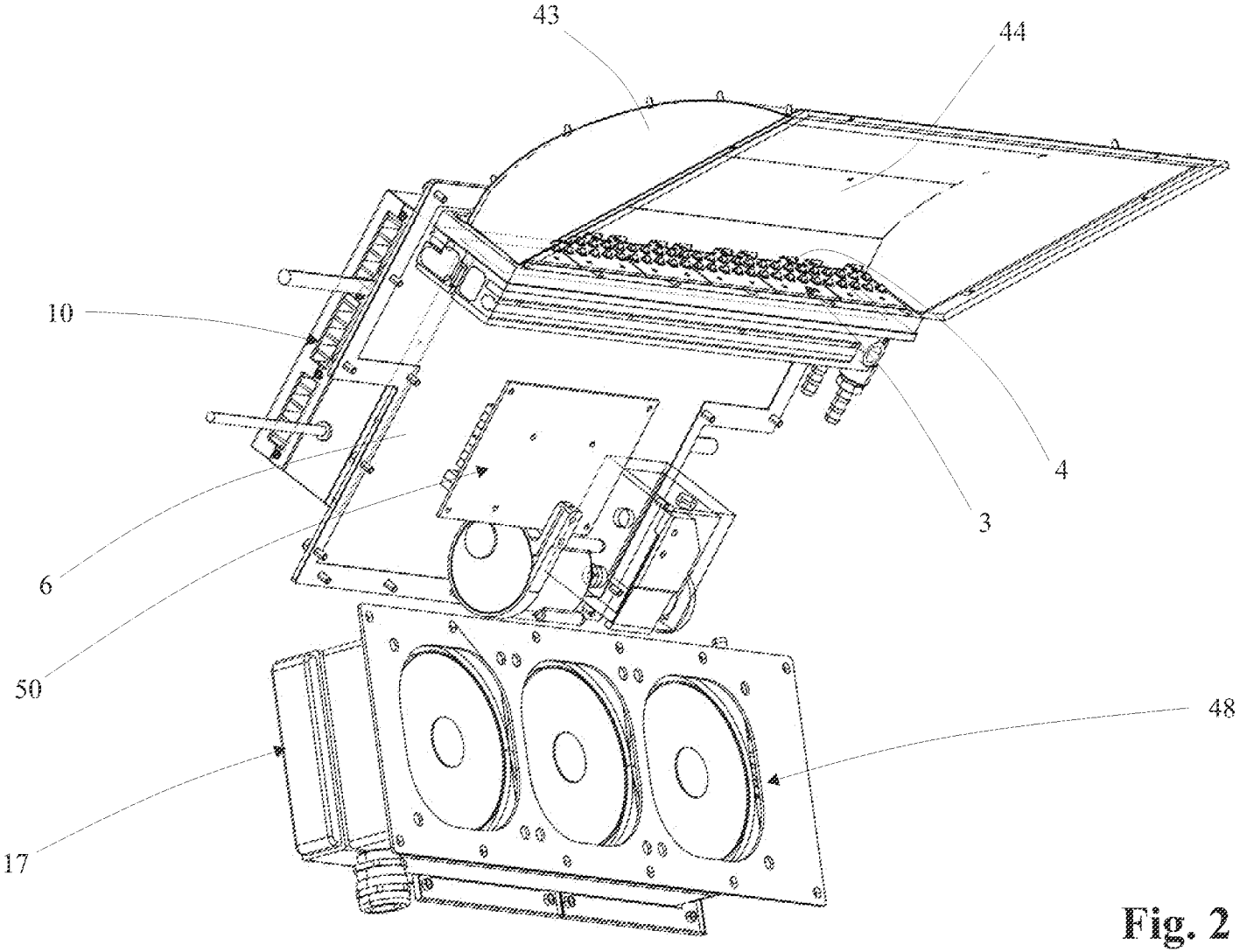
FIG. 2 shows the illumination device illustrated in FIG. 1 with several parts removed in order to better view some internal components of the illumination device itself.

Advantageously, with reference to the embodiment illustrated in FIGS. 1 and 2, the support structure 2 comprises a containment body 5, internally hollow, within which the illumination modules 3 are housed.

Preferably, the containment body 5 is provided with a rear wall 6, which supports the illumination modules 3, and a transparent projection side 7 through which the light beams emitted by the light sources 4 are projecting outward towards the area to be illuminated. In particular, the aforesaid projection side 7 of the containment body 5 has an opening closed by a sheet 8 of light-permeable material, preferably transparent, for example made of glass or plastic material.

Figure 3:
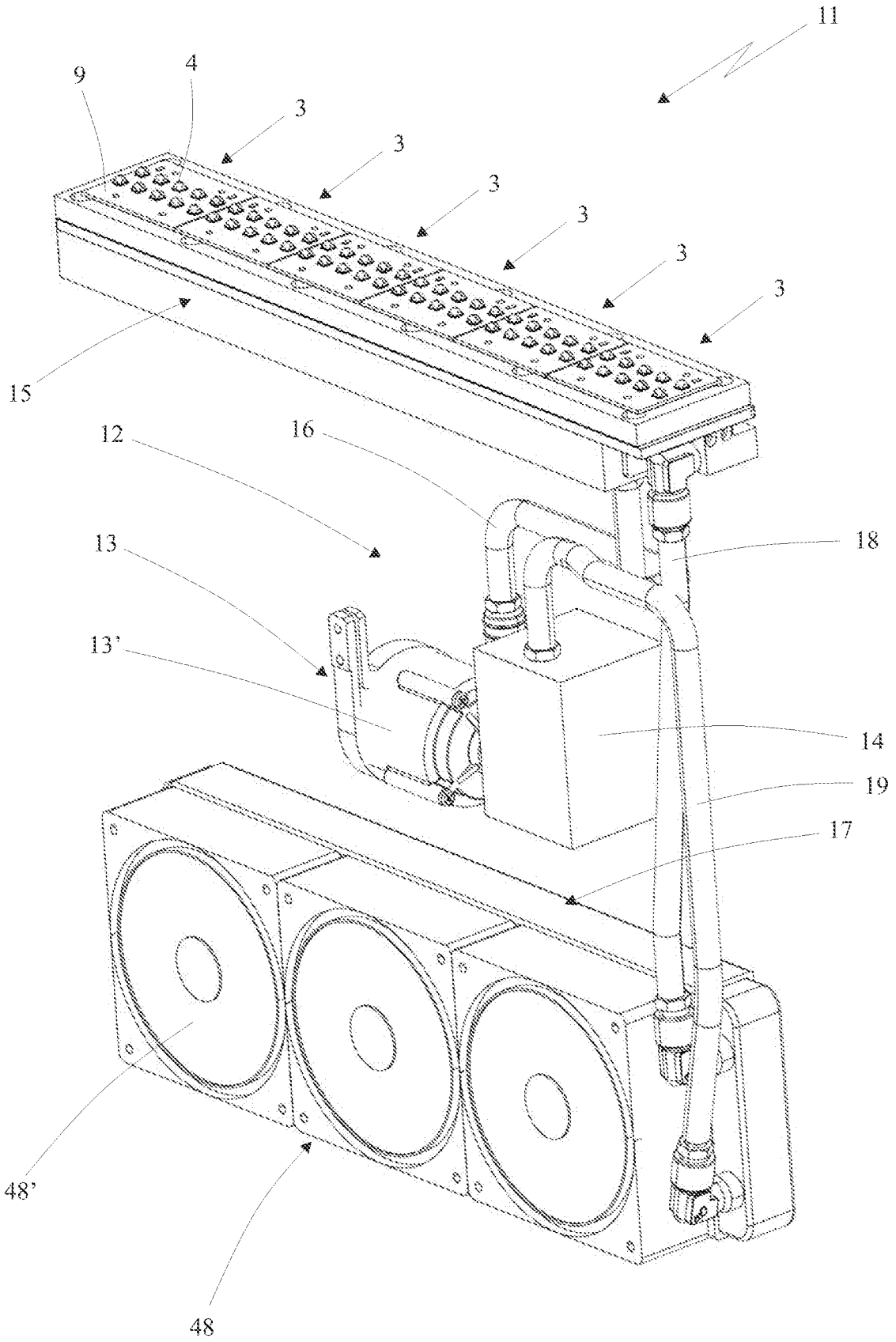
FIG. 3 shows a detail of the present illumination device relative to a cooling plant adapted to dissipate the heat generated by the light sources of the illumination device itself, in accordance with a first embodiment of the present invention.
Figure 4:
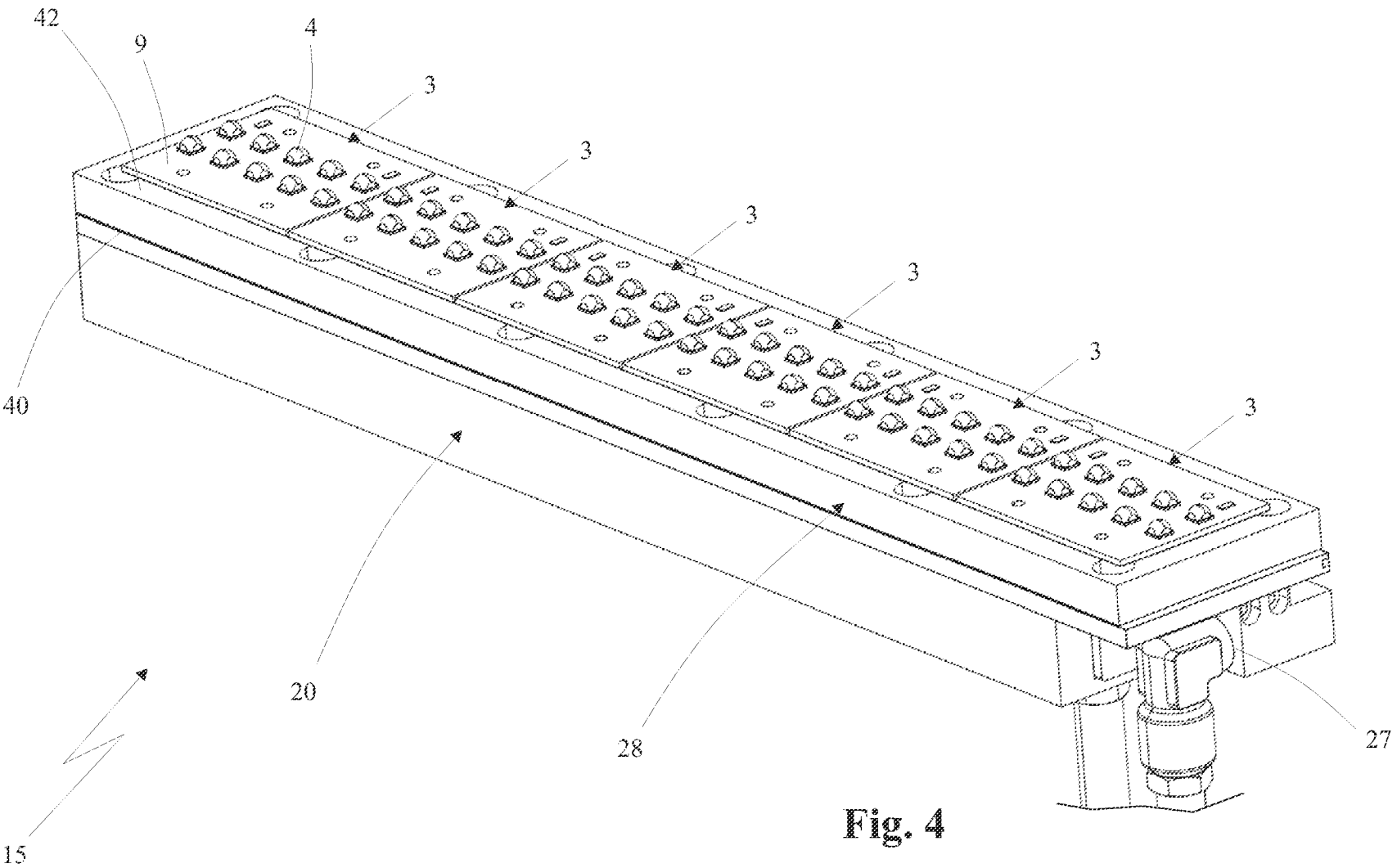
FIG. 4 shows a detail of the cooling plant of FIG. 3 relative to a first heat exchanger intended to be operatively associated with the light sources.

Advantageously, with reference to FIGS. 3 and 4, each illumination module 3 comprises a base plate 9 on which the corresponding group of light sources 4 (in particular LEDs) are mounted, organized in multiple parallel rows.

Preferably, each base plate 9 comprises a printed circuit, in particular of metalcore type, on which metal tracks are made (not illustrated) that are adapted to connect the corresponding light sources 4 to electric cables connected to a control unit 10 arranged for example on the rear wall 6 of the containment body 5.

The present illumination device 1 comprises a liquid cooling plant 11, which is operatively associated with the light sources 4 in order to dissipate the heat generated by the latter during the operation thereof.

More in detail, with reference to the example of FIG. 3, the cooling plant 11 comprises a hydraulic circuit 12 provided with pipes 16, 18, 19 preferably defining a closed circuit within which a coolant fluid, in particular liquid, is susceptible of flowing, constituted for example by a mixture of water and ethyl glycol.

The hydraulic circuit 12 is also provided with pumping system 13 adapted to circulate the coolant fluid in the pipes 16, 18, 19 and advantageously comprising a pump 13', preferably with electrical power supply, arranged within the containment body 5 of the support structure 2.

Preferably, the hydraulic circuit 12 comprises a storage tank 14 connected to the pumping system 13.

The cooling plant 11 also comprises a first heat exchanger 15, which is placed to intercept of the hydraulic circuit 12 in order to be traversed by the coolant fluid. In particular, such first heat exchanger 15 is hydraulically connected to the pumping system 13 by means of a first pipe 16 of the hydraulic circuit 12 in order to receive the coolant fluid at its interior.

The aforesaid first heat exchanger 15 is thermally connected to the light sources 4 of the illumination device 1 in order to transmit at least part of the heat generated by the latter to the coolant fluid which traverses the first heat exchanger 15 itself, so as to reduce the temperature of the light sources 4 during the operation thereof.

In addition, the cooling plant 11 also comprises a second heat exchanger 17 placed to intercept the hydraulic circuit 12 in order to be traversed by the coolant fluid coming from the first heat exchanger 15 and adapted to transfer, to the outside environment, at least part of the heat which was absorbed by the coolant fluid when it traversed the first heat exchanger 15.

In particular, the second heat exchanger 17 is connected by means of a second pipe 18 of the hydraulic circuit 12 to the first heat exchanger 15 in order to receive, from the latter, the heated coolant fluid following the absorption of the heat generated by the light sources 4. Preferably, the second heat exchanger 17 is connected by means of a third pipe 19 of the hydraulic circuit 12 to the pumping system 13 (possibly by means of the interposition of the storage tank 14) in a manner such that the latter conveys the cooled cooling liquid back to the first heat exchanger 15.

Of course, in a manner entirely equivalent to the above-described configuration of the hydraulic circuit 12 (exemplified in FIG. 3), the pumping system 13 (and possibly the storage tank 14) can be arranged in the hydraulic circuit 12, at the outlet of the first heat exchanger 15 and at the inlet of the second heat exchanger 17, in a manner such to receive the coolant fluid that exits from the first heat exchanger 15 and pump it towards the second heat exchanger 17.

In accordance with the idea underlying the present invention, the first heat exchanger 15 comprises a manifold 20 provided with a passage channel 21, within which the coolant fluid preferably coming from the pumping system 13 is susceptible of sliding by means of the first pipe 16 of the hydraulic circuit 12.

Figure 5:
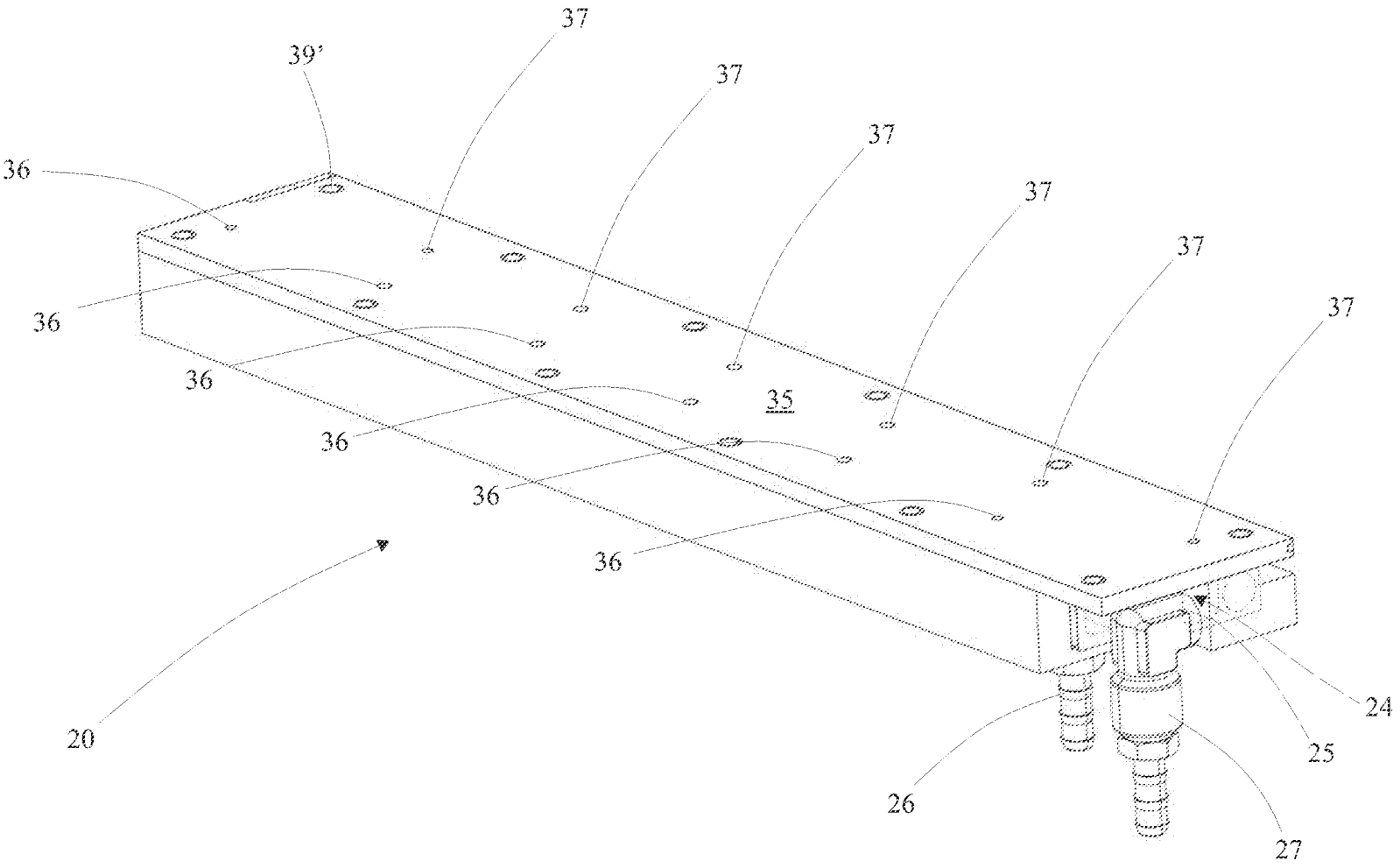
FIG. 5 shows a component of the aforesaid first heat exchanger relative to a manifold for the distribution of the coolant fluid.
Figure 6:
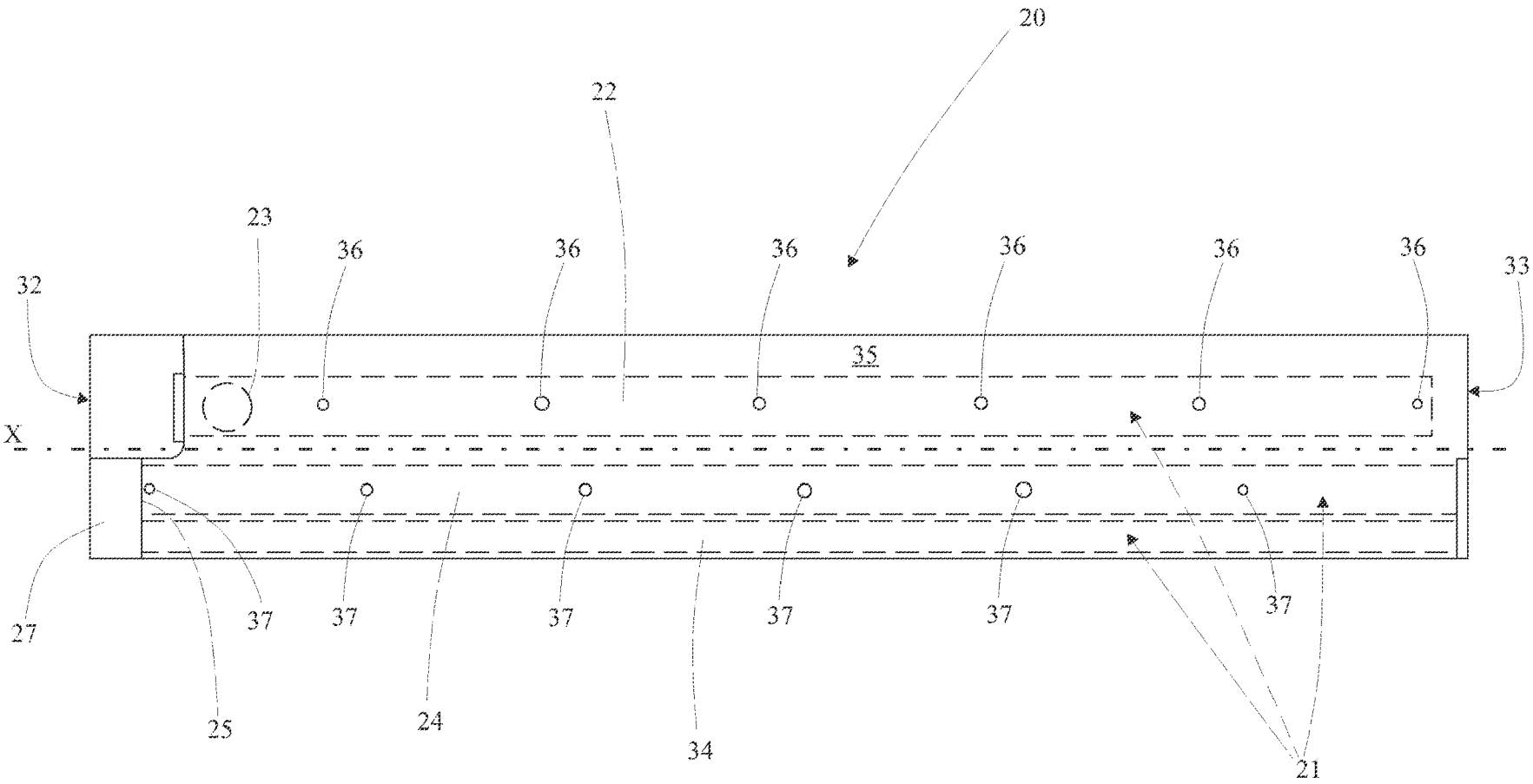
FIG. 6 shows a top view of the manifold illustrated in FIG. 5.

With reference to FIGS. 5 and 6, the passage channel 21 of the manifold 20 comprises an inlet branch 22 provided with a delivery opening 23 connected to the hydraulic circuit 12 in order to make the coolant fluid enter into the passage channel 21, and an outlet branch 24 provided with an expulsion opening 25 connected to the hydraulic circuit 12 in order to make the coolant fluid exit from the passage channel 21 itself.

In particular, the delivery opening 23 is connected to the first pipe 16 of the hydraulic circuit 12, e.g. by means of a first connector 26, in order to make the cooling fluid preferably coming from the pumping system 13 enter within the manifold 20. The expulsion opening 25 of the passage channel 21 is connected, for example by means of a second connector 27, to the second pipe 18 of the hydraulic circuit 12 in order to convey the coolant fluid towards the second heat exchanger 17.

The first heat exchanger 15 also comprises at least one heat transmission block 28, which is made of thermally conductive material, preferably metal material such as copper or a copper alloy.

Such heat transmission block 28 carries the illumination modules 3 mounted thereon and is thermally coupled to the latter in order to receive the heat generated by the light sources 4 during the operation thereof.

In addition, the heat transmission block 28 is provided with multiple cooling tracks 29 hydraulically connected, parallel to each other, to the inlet branch 22 and to the outlet branch 24 of the passage channel 21 of the manifold 20, in a manner such to allow the passage of the coolant fluid within the cooling tracks 29 themselves. Each of such cooling tracks 29 is arranged at a respective illumination module 3 in order to transfer the heat generated by the light sources 4 of such illumination module 3 to the coolant fluid which traverses the cooling track 29 itself, preferably by means of heat conduction through the material of the heat transmission block 28.

In particular, the cooling tracks 29 of the heat transmission block 28 are arranged in succession one after the other along the extension of the inlet 22 and outlet 24 branches of the passage channel 21 of the manifold 20.

Advantageously, the cooling tracks 29 of the heat transmission block 28 are placed to connect the inlet branch 22 with the outlet branch 24 of the passage channel 21 of the manifold 20, in a manner such that the coolant fluid passes from the inlet branch 22 to the outlet branch 24 through such cooling tracks 29.

More in detail, each cooling track 29 is extended between an inlet end 30, connected to the inlet branch 22 of the passage channel 21 of the manifold 20, and an outlet end 31 connected to the outlet branch 24 of the passage channel 21 itself.

Advantageously, the claimed arrangement of the cooling tracks 29 connected parallel to each other ensures that the coolant fluid which enters into each of such cooling tracks 29 from the inlet branch 22 of the passage channel 21 substantially has the same temperature as the fluid that enters into the other cooling tracks 29, since the part of coolant fluid that enters into a cooling track 29 has not absorbed the heat of the illumination module 3 associated with the preceding cooling track 29 of the succession, ensuring an efficient and uniform cooling of all the illumination modules 3. In particular, the temperature of the coolant fluid which traverses each cooling track 29 allows the fluid to absorb a significant quantity of heat generated by the light sources 4 of the corresponding illumination module 3, ensuring a suitable cooling of the light sources 4 themselves. This advantageously allows ensuring a suitable operating temperature (e.g. lower than about 60° C.) of the light sources 4 (in particular LEDs) with considerable power and arranged on a relatively small surface area (e.g. about 40 mm×7 mm). This allows maintaining limited dimensions of the illumination device 1 since it is possible to concentrate, in a limited space, many high-power light sources 4 in order to generate a great luminous flux (e.g. 140000-180000 lumen) and, simultaneously, it ensures a temperature of the light sources 4 that is low enough to be able to ensure an operating lifetime thereof (e.g. greater than 50000 hours).

In accordance with the embodiment illustrated in FIGS. 3-8, the illumination device 1 comprises only one aforesaid heat transmission block 28, which carries multiple illumination modules 3 mounted thereon and is provided with multiple corresponding cooling tracks 29.

Figure 9:
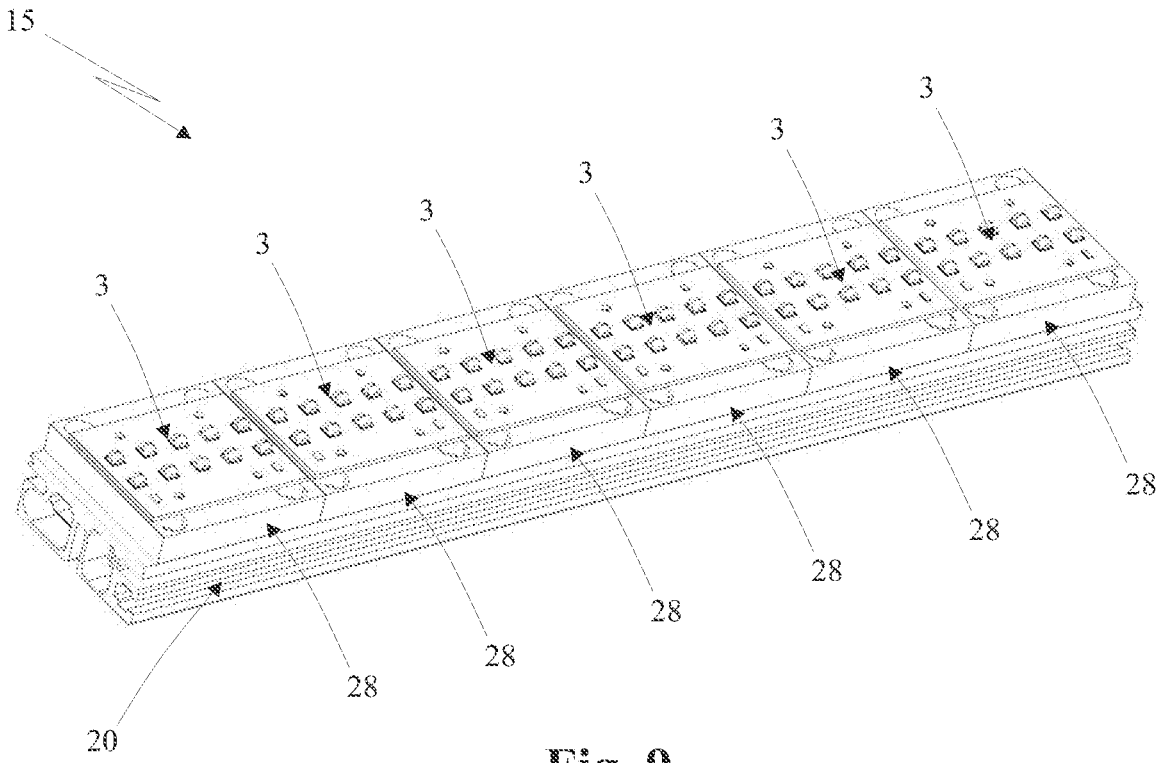
FIG. 9 shows the first heat exchanger in accordance with a second embodiment of the present invention.
Figure 10:
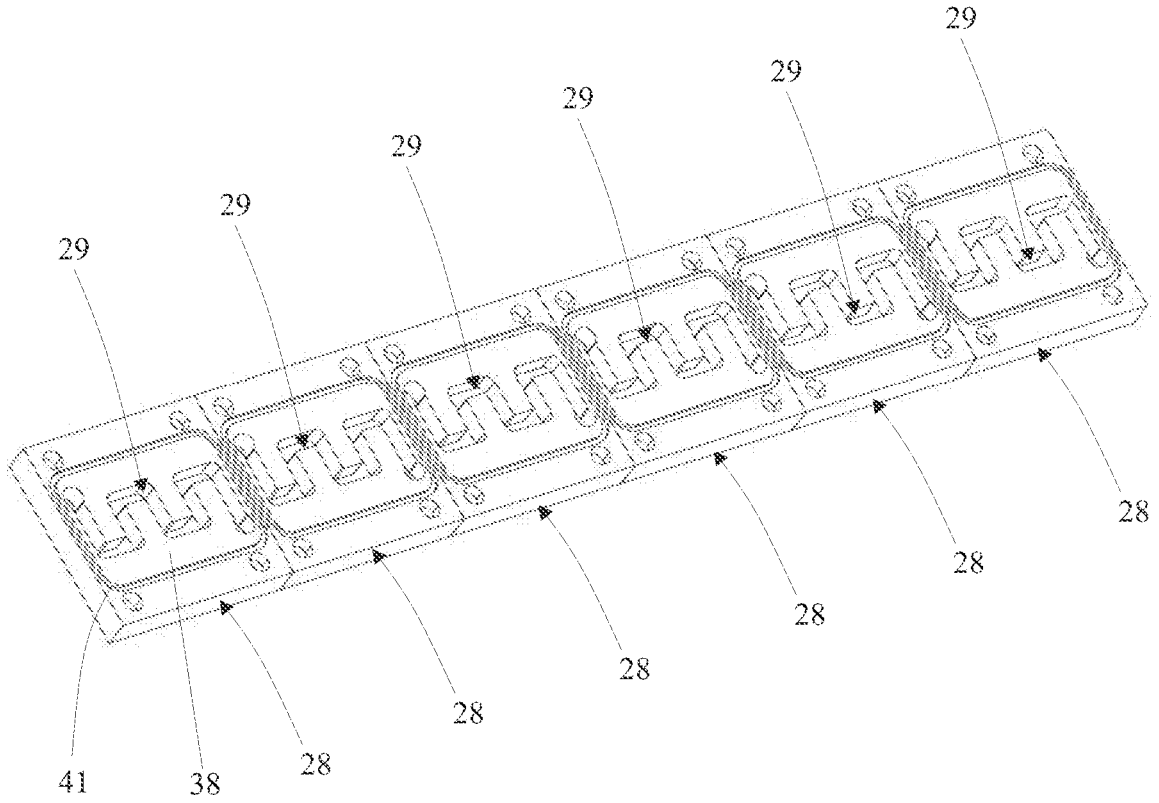
FIG. 10 shows a detail of the first heat exchanger illustrated in FIG. 9, relative to the heat transmission blocks coupled to the light sources.
Figure 11:
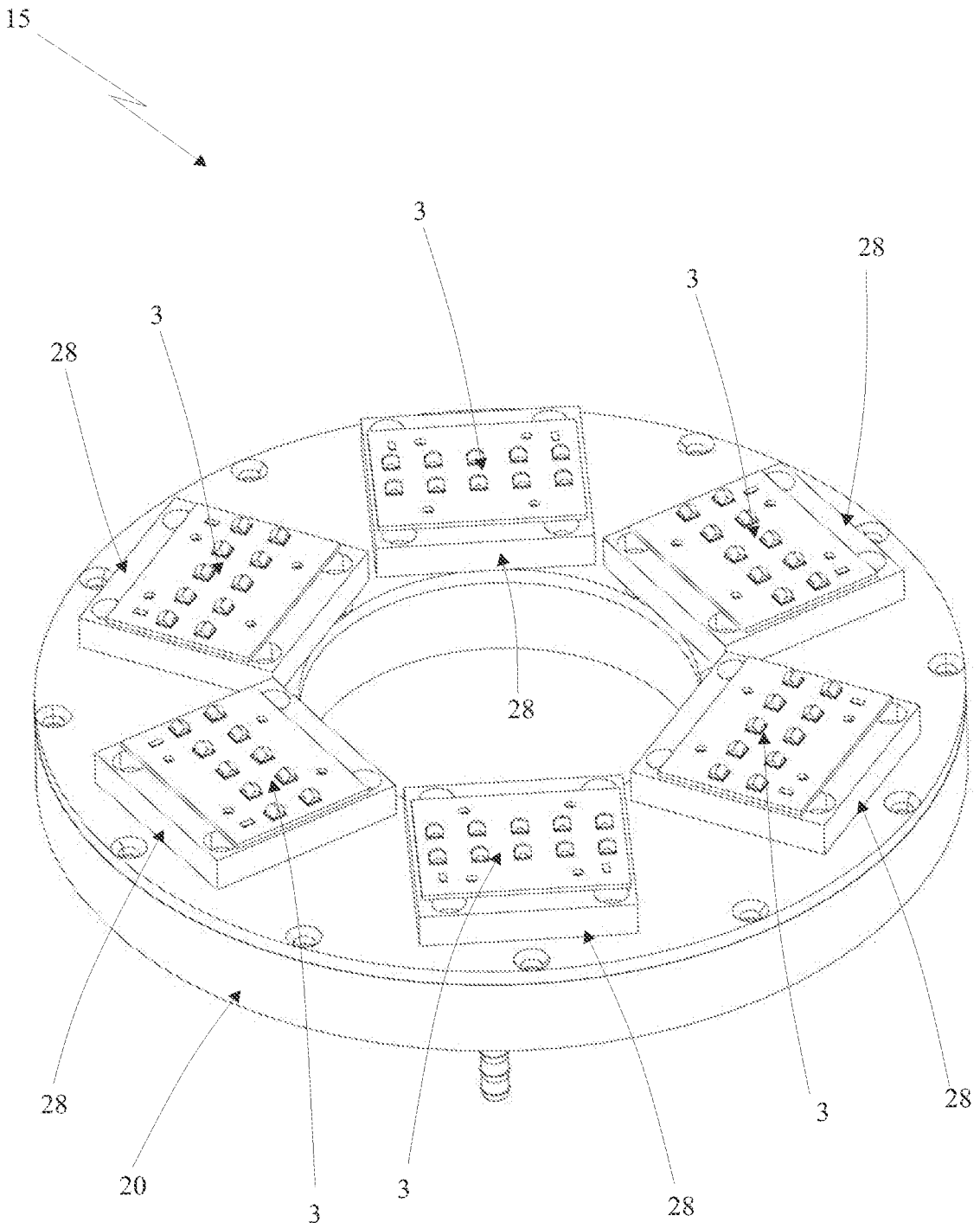
FIG. 11 shows the first heat exchanger in accordance with a third embodiment of the present invention.

Otherwise, in accordance with the embodiments illustrates in FIGS. 9, 10 and 11, the illumination device 1 comprises multiple heat transmission blocks 28, each carrying the corresponding illumination module 3 mounted thereon and provided with the corresponding cooling track 29 (or, in accordance with an embodiment variant which is not illustrated, each heat transmission block 28 carries multiple illumination modules 3 mounted thereon and is provided with multiple corresponding cooling tracks 29).

Advantageously, the manifold 20 of the first heat exchanger 15 is made of thermally conductive material, preferably metal and in particular aluminum or an aluminum alloy, and is preferably obtained by means of extrusion.

Advantageously, the manifold 20 is extended according to a first extension direction X between a first end 32 and a second end 33, preferably with elongated shape. In particular, in accordance with the embodiments illustrated in FIGS. 1-10, the extension direction X of the manifold 20 is substantially rectilinear. Otherwise, the extension direction X of the manifold 20 can have different shape, e.g. circular as in the example of FIG. 11 (in which, in particular, the ends 32, 33 of the manifold 20 are close to each other or substantially coinciding).

Advantageously, the inlet 22 and outlet 24 branches of the passage channel 21 of the manifold 20 are extended side-by-side each other and substantially parallel according to the aforesaid first extension direction X.

In particular, the inlet 22 and outlet 24 branches of the passage channel 21 are arranged in a manner such to be traversed by the coolant fluid traveling in opposite directions therein.

According to the embodiments illustrated in FIGS. 1-10, the delivery 23 and expulsion 25 openings of the passage channel 21 of the manifold 20 are substantially positioned at the same (e.g. the first 32) end of the manifold 20 itself. Of course, in accordance with a different configuration, not illustrated, the delivery 23 and expulsion 25 openings can be positioned at different ends 32, 33 of the manifold 20. Advantageously, for such purpose, the passage channel 21 of the manifold 20 comprises at least one auxiliary branch 34 arranged, for example with reference to the example of FIG. 6, parallel to and side-by-side the outlet branch 24. In the example of FIG. 6, such auxiliary branch is closed, not being used. Otherwise, it is possible to connect the auxiliary branch 34 to the outlet branch 24, as an extension of the latter, at the first end 32 of the manifold 20 (e.g. by means of a connector manifold) and open the auxiliary branch 34 at the second end 33 of the manifold 20, in a manner such to arrange the expulsion opening 25 of the passage channel 21 at such second end 33. The advantageous use of the aforesaid auxiliary branch 34 allows configuring the manifold 20 in versatile manner as a function of the arrangement of the elements (for example the pumping system 13) of the cooling plant 11 within the illumination device 1.

Advantageously, the manifold 20 is provided with a first face 35, preferably flat, on which a series of first connection holes 36 are made in communication with the inlet branch 22 of the passage channel 21 and a series of second connection holes 37 are made in communication with the outlet branch 24 of the passage channel 21 itself. In particular, the series of the first connection holes 36 and of the second connection holes 37 are arranged on the aforesaid first face 35 of the manifold 20, along the extension respectively of the inlet branch 22 and of the outlet branch 24 of the passage channel 21. Each cooling track 29 of the heat transmission block 28 is extended between its inlet end 30, which is connected to a corresponding first connection hole 36 of the first face 35 of the manifold 20 in order to allow the entrance of the coolant fluid from the inlet branch 22 of the passage channel 21, and its outlet end 31, which is connected to a corresponding second connection hole 37 of the first face 35 of the manifold 20 in order to allow the exit of the coolant fluid into the outlet branch 24 of the passage channel 21. Advantageously, with reference to the examples illustrated in FIGS. 7, 8 and 10, the heat transfer block 28 is provided with a second face 38 fixed to the first face 35 of the manifold 20, on which the aforesaid cooling tracks 29 are attained.

In particular, the cooling tracks 29 are obtained by means of corresponding grooves made on the second face 38 of the heat transmission block 28 and extended depth-wise for a specific section of the thickness of the heat transfer block 28, having an open side thereof on second face 38 of the latter.

Advantageously, the heat transmission block 28 is rigidly fixed to the manifold 20 by means of a fixing system (not illustrated) comprising for example bolts which employ corresponding connection holes 39', 39" of the heat transmission block 28 and of the manifold 20.

Preferably, the second face 38 of the heat transmission block 28 is positioned in adherence on the first face 35 of the manifold 20, in a manner such that the open side of each cooling track 29 is closed by the first face 35 of the manifold 20, except of course for the zones at the ends 30, 31 of each cooling track 29 which are arranged facing the corresponding connection holes 36, 37 of the first face 35 in order to allow the passage of the coolant fluid within the cooling tracks 29.

In particular, each cooling track 29 is delimited between the heat transmission block 28 and the manifold 20.

Advantageously, the first face 35 and the second face 38 are smoothed (e.g. by means of lapping) and are preferably flat, in a manner such to adhere to each other, preventing the infiltration of coolant fluid between such faces 35, 38.

In accordance with the embodiment illustrated in the enclosed figures, the manifold 20 is made in a single body, for example with a metal section, which defines the aforesaid first face 35 in contact with the second face 38 of the heat transmission block 28. In accordance with a different embodiment, not illustrated, the manifold 20 can comprise multiple separate components, such as a further connection plate placed between the aforesaid metal section of the manifold 20 and the heat transmission block 28 and defining the first face 35 in contact with the second face 38 of the heat transmission block 28 (and provided for example with connection channels for connecting the cooling tracks 29 to the passage channel 21).

In accordance with a further different embodiment, the first face 35 of the manifold 20 may also be only partially in adherence on the second face 38 of the heat transmission block 28, having for example one or more cavities defining spacing zones between the manifold 20 and the heat transmission block 28.

In addition, in accordance with a further embodiment, not illustrated, each cooling track 29 could be attained not only on the second face 38 of the heat transmission block 28, but also in part on the first face 35 of the manifold 20.

Advantageously, the first heat exchanger 15 comprises an annular seal 40 sealingly interposed between the first face 35 of the manifold 20 and the second face 38 of the heat transmission block 28 and extended as a ring around the zone of the second face 38 on which the cooling tracks 29 are made.

Such annular seal 40 is for example made of polymer material, in particular elastic, and preferably has the object of preventing leakage from the first heat exchanger 15 of possible coolant fluid that has infiltrated between the first face 35 and the second face 38, respectively of the manifold 20 and of the heat transmission block 28.

In accordance with the embodiment illustrated in the enclosed figures, the annular seal 40 is positioned along the perimeter of the first and second face 35, 38 of the manifold 20 and of the heat transmission block 28. Otherwise, the annular seal 40 can also be arranged in a zone inside the perimeter of the first and second face 35, 38 themselves.

In the embodiment illustrated in the enclosed figures, the annular seal 40 is made of a single body and preferably has quadrangular shape. Of course, without departing from the protective scope of the present invention, the annular seal 40 can also be formed by separate portions that are fixed to each other and have non-quadrangular shape (e.g. hexagonal, circular, etc.).

Advantageously, the first face 35 of the manifold 20 and/or the second face 38 of the heat transmission block 28 is provided with an annular groove 41 with shape substantially corresponding to the annular seal 40 which is housed to size in such annular groove 41, in a manner such to ensure the adherence between the first face 35 and the second face 38.

Figure 7:
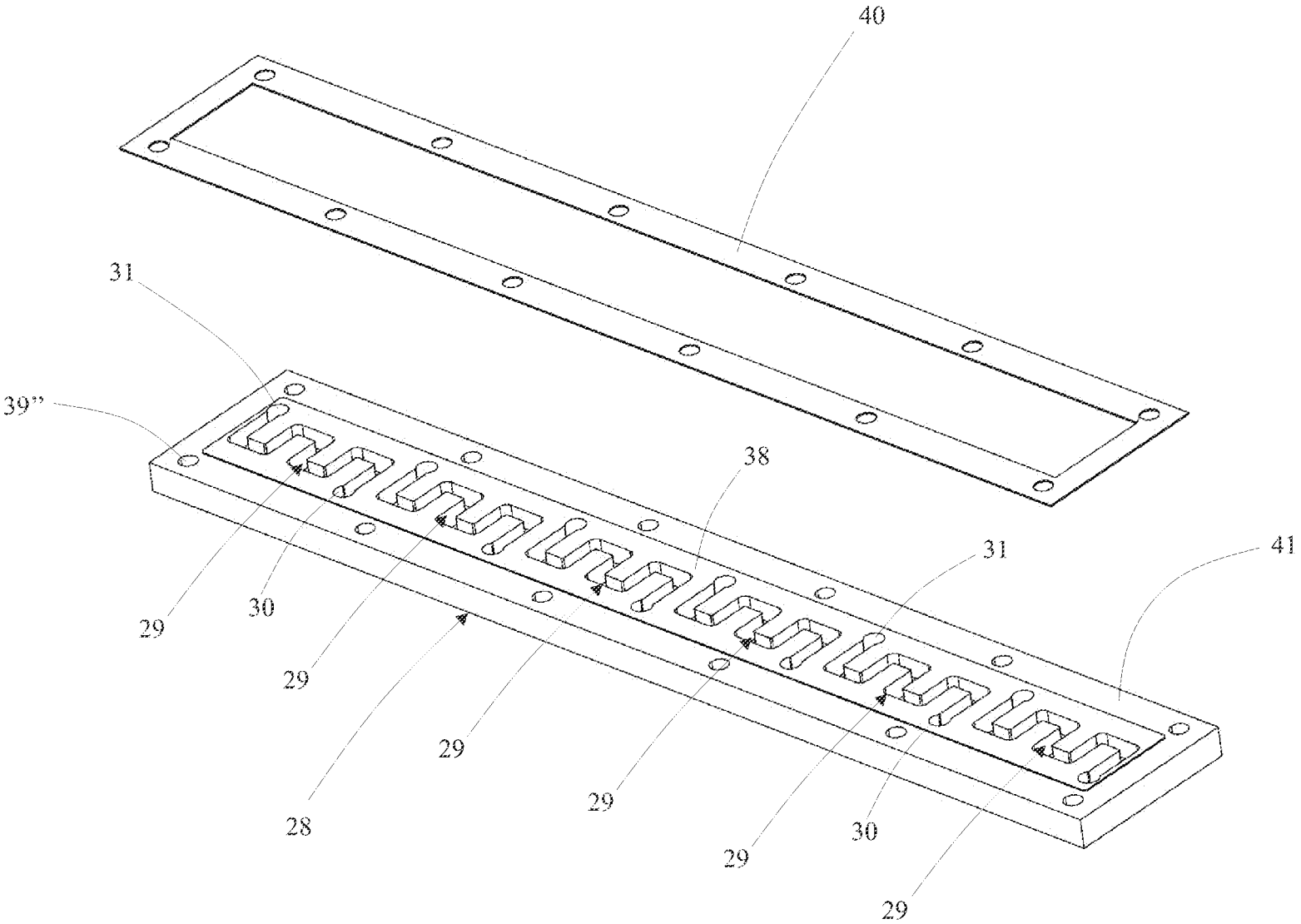
FIG. 7 shows a further component of the first heat exchanger relative to a heat transmission block coupled to the light sources.
Figure 8:
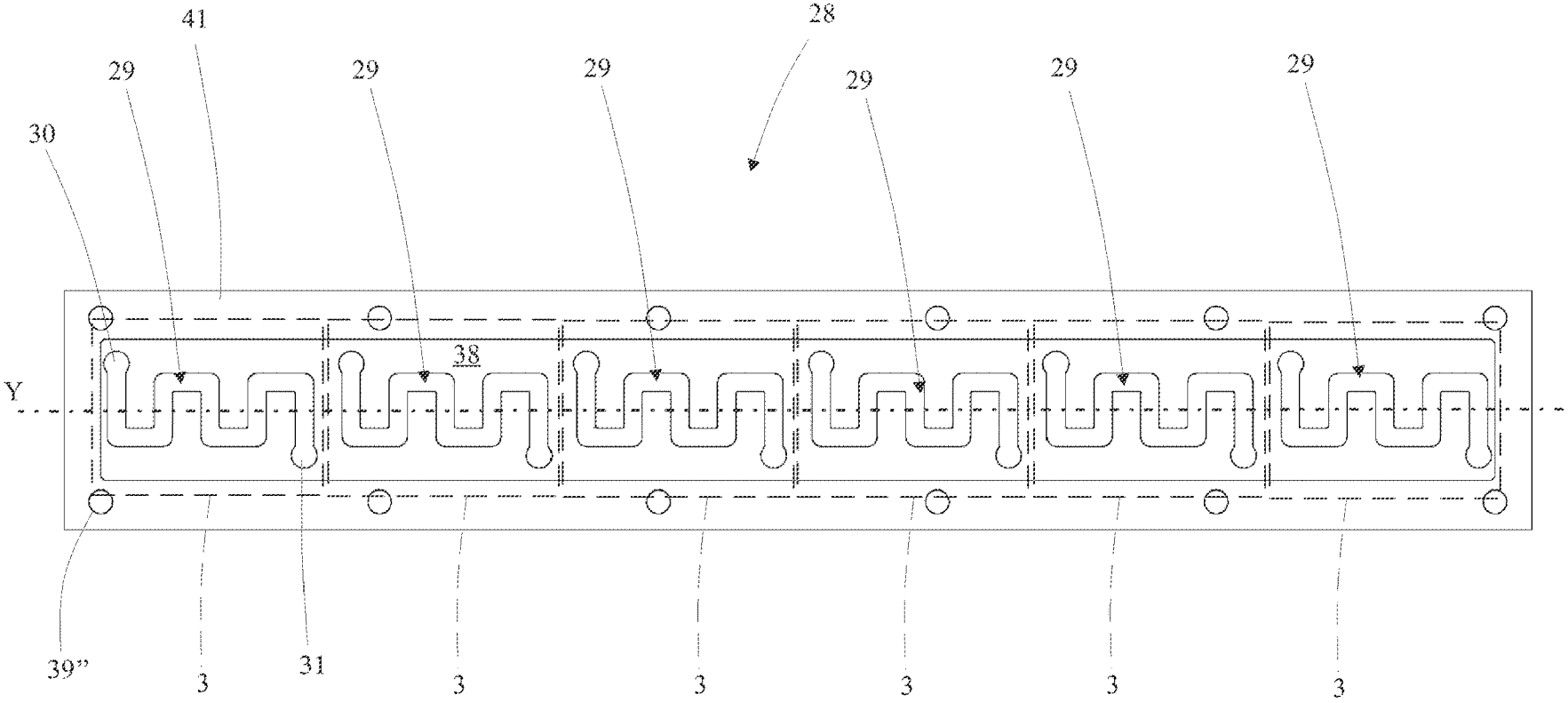
FIG. 8 shows a top view of the heat transmission block illustrated in FIG. 7.

In accordance with the particular embodiments illustrated in FIGS. 7, 8 and 10, the annular groove 41 is made on the second face 38 of the heat transmission block 28 in particular along the perimeter of such second face 38.

In accordance with the embodiment illustrated in FIGS. 7 and 8, the annular seal 40 and the corresponding annular groove 41 are extended around an area that contains multiple cooling tracks 29 (e.g. all the cooling tracks 29 of the heat transmission block 28).

In accordance with the embodiment illustrated in FIG. 10, in which multiple heat transmission blocks 28 are provided, the annular seal 40 and the corresponding annular groove 41 of each heat transmission block 28 are extended around the corresponding cooling track 29.

Advantageously, with reference to the embodiments illustrated in FIGS. 3-9, the heat transmission block 28 is extended, with preferably elongated shape, along a second extension direction Y parallel to the first extension direction X of the manifold 20 and in particular has width and length substantially equal to those of the manifold 20. In particular, in the examples of FIGS. 3-8, the second extension direction Y of the heat transmission block 28 has rectilinear shape. Of course, in accordance with different non-illustrated embodiments, the transmission block 28 can have different shapes as a function, in particular, of the first extension direction X of the manifold 20 and/or of the extension of the inlet 22 and outlet 24 branches of the passage channel 21 of the manifold 20 itself.

In accordance with the embodiments of FIGS. 9, 10 and 11, multiple heat transfer blocks 28 are provided, arranged along the inlet 22 and outlet 24 branches of the passage channel 21 of the manifold 20.

Preferably, the heat transmission block 28 is a solid body (in particular made of metal such as copper or a copper alloy), in which the cooling track(s) 29 are made via removal (e.g. milling) on the second face 38 of the heat transmission block 28 itself.

Advantageously, the heat transmission block 28 is provided with a support face 42 which is directed in the direction opposite its second face 38, on which the illumination modules 3 are fixed.

In particular, the support face 42 has substantially flat shape and is preferably parallel to the second face 38 of the heat transmission block 28.

Preferably, the heat transmission block 28 is shaped in plate form (in particular flattened) and has the two opposite and larger faces of which one defines the second face 38 and the other the support face 42.

Preferably, on the support face 42, the base plates 9 of the illumination modules 3 are fixed, in particular by means of fixing screws (not illustrated), possibly with the interposition of intermediate thermally conductive elements (such as metal plates) between the support face 42 and the base plates 9.

Advantageously, the illumination modules 3 are positioned one after the other on the support face 42 of the heat transmission block 28 along the second extension direction Y of the latter.

In particular, the cooling tracks 29 of the heat transmission block 28 are positioned on areas of the second face 38 which, with reference to the plan view of FIG. 8, are substantially superimposed on the illumination modules 3 arranged on the opposite support face 42, so as to facilitate the transmission of the heat from the light sources 4 of each illumination module 3 to the coolant fluid which flows in the corresponding cooling tracks 29.

Advantageously, each cooling track 29 has a substantially coil-like extension, in a manner such to be extended for most of the width of the corresponding illumination module 3.

Advantageously, in accordance with a particular embodiment of the present invention (not illustrated), the first connection holes 36 of the manifold 20 arranged along the inlet branch 22 of the passage channel 21 have diameters that are increasing, one with respect to the preceding starting from the delivery opening 23 of the inlet branch 22 itself. Preferably, in addition or as an alternative, the second connection holes 37 of the manifold 20 arranged along the outlet branch 24 of the passage channel 21 have diameters that are increasing, one with respect to the preceding going towards the expulsion opening 25 of the outlet branch 24 itself. Such configuration of the first and/or second connection holes 36, 37 allows compensating for possible load losses of the coolant fluid along the branches of the passage channel 21 by ensuring a suitable pressure of the coolant fluid even in the cooling tracks 29 furthest from the delivery opening 23 of the passage channel 21 of the manifold 20.

Advantageously, with reference to the example illustrated in FIGS. 1 and 2, the containment body 5 of the support structure 2 houses the illumination modules 3 and the first heat exchanger 15 and, preferably, the pumping system 13.

In particular, the first heat exchanger 15 is fixed with a lateral flank thereof to the rear wall 6 of the containment body 5 and carries, fixed thereto, the illumination modules 3 on the support face 42 of the heat transmission block 28.

Advantageously, the illumination device 1 comprises a reflection body 43 arranged in the containment body 5 (in particular fixed on the support face 42 of the heat transmission block 28) and provided with a reflection surface 44 with substantially conical shape arranged in front of the light sources 4 in order to intercept the light beams emitted by the latter, such surface 44 directed towards the projection side 7 of the containment body 5 in order to project the light beams towards such projection side 7 so as to emit them outward onto the area to be illuminated.

In particular, the reflection surface 44 is configured for reflecting the light beams emitted by the light sources 4 by concentrating and/or collimating them, so as to increase the light intensity generated by the illumination device 1.

Advantageously, the reflection surface 44 of the reflection body 43 is extended along a direction parallel to the extension directions X, Y starting from a generatrix section having the shape substantially of a conical section, for example of a parabola section, in particular with the focus arranged substantially at the illumination modules 3. In particular, the generatrix section of the reflection surface 44 can have a piecewise linear or curvilinear progression.

In particular, the support structure 2 of the illumination device 1 comprises a base body 45 intended to be fixed to the installation support and connected to the containment body 5 of the illumination device 1 preferably by means of a hinge junction 46 having an axis parallel to the extension directions X, Y. Such hinge junction 46 advantageously allows adjusting the tilt of the containment body 5 (and hence of the projection direction of the light beams exiting from the projection side 7 of the containment body 5) and allows limiting the bulk of the illumination device 1 during the storage and transport operations.

Advantageously, the second heat exchanger 17 is arranged within the base body 45 of the support structure 2 (for such purpose internally hollow) and is preferably connected to the first heat exchanger 15 and to the pumping system 13 by means of flexible pipes 18, 19.

Advantageously, the second heat exchanger 17 is in communication with the outside environment in order to transfer to the external air the heat received by the coolant fluid, in particular by means of suitable first aeration openings 47 made in the base body 45 of the support structure 2.

Preferably, the second heat exchanger 17 is of finned pack type so as to optimize the dissipation of the heat.

Advantageously, the cooling plant 11 comprises a ventilation system 48 operatively associated with the second heat exchanger 17 and arranged for generating an air flow adapted to intercept the second heat exchanger 17 in order to receive the heat of the latter and transport it outside.

In particular, such ventilation system 48 comprises one or more fans 48' advantageously arranged adjacent to the second heat exchanger 17 and preferably positioned within the base body 45.

In operation, the ventilation system 48 is adapted to suction air from the outside environment (e.g. by means of second aeration openings 49 of the base body 45) and to generate the air flow that intercepts the second heat exchanger 17, exiting outward (in particular by means of the first aeration openings 47 of the base body 45) so as to remove the heat received from the second heat exchanger 17.

Advantageously, the illumination device 1 comprises an electronic unit 50 adapted to control the operation of the cooling plant 11 (and in particular of the pumping system 13 and ventilation system 48), preferably arranged in the containment body 5 (or possibly integrated with the control unit 10 of the light sources 4).

The invention thus conceived therefore attains the pre-established objects.

The invention claimed is:

1. An illumination device, comprising:

a support structure (2);

multiple illumination modules (3) mounted on said support structure (2) and each comprising a corresponding group of light sources (4);

a liquid cooling plant (11), which is operatively associated with said light sources (4) in order to dissipate heat generated by said light sources (4) during the operation of said light sources (4); wherein said liquid cooling plant (11) comprises:

a hydraulic circuit (12) provided with a pumping system (13) adapted to circulate a coolant fluid in said hydraulic circuit (12);

a first heat exchanger (15), which is placed to intercept said hydraulic circuit (12) in order to be traversed by said coolant fluid and is thermally connected to said light sources (4) in order to transmit at least part of the heat generated by said light sources (4) to said coolant fluid;

a second heat exchanger (17) placed to intercept said hydraulic circuit (12) in order to be traversed by said coolant fluid and adapted to transfer, to an outside environment, at least part of the heat that was absorbed by said coolant fluid in said first heat exchanger (15);

wherein said first heat exchanger (15) comprises:

a manifold (20) provided with a passage channel (21) which comprises an inlet branch (22) provided with a delivery opening (23) connected to said hydraulic circuit (12) in order to make said coolant fluid enter into said passage channel (21), and an outlet branch (24) provided with an expulsion opening (25) connected to said hydraulic circuit (12) in order to make said coolant fluid exit from said passage channel (21);

at least one heat transmission block (28) made of thermally conductive material; wherein said at least one heat transmission block (28) carries said illumination modules (3) mounted thereon and is provided with multiple cooling tracks (29) which are hydraulically connected, parallel to each other, to the inlet branch (22) and to the outlet branch (24) of the passage channel (21) of said manifold (20) and are each arranged at a respective said illumination module (3), in order to transfer the heat generated by the light sources (4) of said illumination module (3) to the coolant fluid which traverses said cooling track (29).

2. The illumination device of claim 1, wherein said manifold (20) is provided with a first face (35), which is provided with a first series of first connection holes (36) which are in communication with the inlet branch (22) of said passage channel (21);

wherein said first face (35) is provided with a second series of second connection holes (37) which are in communication with the outlet branch (24) of said passage channel (21);

wherein each cooling track (29) of said at least one heat transmission block (28) is extended between an inlet end (30) and an outlet end (31) respectively connected to a corresponding said first connection hole (36) and to a corresponding said second connection hole (37) of the first face (35) of said manifold (20).

3. The illumination device of claim 2, wherein said at least one heat transmission block (28) is provided with a second face (38) fixed to the first face (35) of said manifold (20); wherein said cooling tracks (29) are placed on said second face (38).

4. The illumination device of claim 3, wherein the second face (38) of said at least one heat transmission block (28) is positioned in adherence on the first face (35) of said manifold (20), in a manner such that a side of each said cooling track (29) is closed by said first face (35).

5. The illumination device of claim 4, wherein said first heat exchanger (15) comprises an annular seal (40), which is sealingly interposed between the first face (35) of said manifold (20) and the second face (38) of said at least one heat transmission block (28), and is extended around at least one of said cooling tracks (29).

6. The illumination device of claim 5, wherein the first face (35) of said manifold (20) and/or the second face (38) of said at least one heat transmission block (28) is provided with an annular groove (41) having shape substantially corresponding to said annular seal (40) which is housed to size in said annular groove (41).

7. The illumination device of claim 3, wherein said at least one heat transmission block (28) is provided with a support face (42) directed in the direction opposite said second face (38); wherein said illumination modules (3) are fixed on said support face (42).

8. The illumination device of claim 1, wherein said support structure (2) comprises a containment body (5), within which said illumination modules (3) and said first heat exchanger (15) are housed, said containment body (5) being provided with a projection side (7) through which light beams emitted by said light sources (4) are susceptible of being projected outward;

wherein said illumination device further comprises a reflection body (43) arranged in said containment body (5) and provided with a reflection surface (44) with conical shape, arranged in front of said light sources (4) in order to intercept the light beams emitted by said light sources (4) and directed towards the projection side (7) of said containment body (5) in order to project said light beams towards said projection side (7).

9. The illumination device of claim 1, wherein the inlet branch (22) and the outlet arm (24) of said manifold (20) are parallel to and side-by-side each other.

10. The illumination device of claim 1, wherein said at least one heat transmission block (28) comprises a solid body in which one or more of said cooling tracks (29) are obtained via removal.

* * * * *